United States Patent [19]

Stark

[11] Patent Number: 5,004,221

[45] Date of Patent: Apr. 2, 1991

[54] DEVICE FOR CONVEYING PLATE-LIKE MATTER WITHIN A ROTARY PRINTING MACHINE

[75] Inventor: Charles Stark, Prilly, Switzerland

[73] Assignee: Bobst SA, Lausanne, Switzerland

[21] Appl. No.: 419,715

[22] Filed: Oct. 11, 1989

[30] Foreign Application Priority Data

Oct. 12, 1988 [CH] Switzerland ..... 3807/88

[51] Int. Cl.[5] ..... B65H 29/24

[52] U.S. Cl. ..... 271/194

[58] Field of Search ..... 271/194, 196, 306, 276, 271/275, 264; 101/232, 279

[56] References Cited

U.S. PATENT DOCUMENTS 3,845,950 11/1974 Kuzniak ..... 271/194

3,848,752 11/1974 Branch et al. ..... 271/196 X 4,174,104 11/1979 Garvey ..... 271/272

*Primary Examiner*—David H. Bollinger

*Attorney, Agent, or Firm*—Hill, Van Santen, Steadman & Simpson

[57] ABSTRACT

A device for conveying a sheet of material from one printing unit to a second printing unit consisting of a frame having horizontal lateral beams, a plurality of cross-shafts extending between the beams, each shaft being provided with a plurality of axially-spaced rollers, a plate being mounted on a lower surface of each of the lateral beams having apertures arranged to allow a lower portion of each roller to extend therethrough and an arrangement for applying a suction to the interior of the frame to draw air in the gap between each aperture and roller to hold a sheet against the rollers as it is conveyed from one unit to the next.

11 Claims, 3 Drawing Sheets

DEVICE FOR CONVEYING PLATE-LIKE MATTER WITHIN A ROTARY PRINTING MACHINE

BACKGROUND OF THE INVENTION

The present invention is directed to a device for conveying a plate-like sheet, such as sheets of paper board or corrugated board, within a rotary multi-color printing machine for plate-like matter or sheets.

In practical use, machines, which include a feeding station and several printing units allowing a production of a multi-color print and, if necessary, a cutting station, a stripping station and final station for the delivery of the sheets, must be able to handle sheets having important dimension up to a length of 5 meters and a width of 3 meters. The use of such a machine involves the compulsory accessibility to the inner space of the printing unit, whether it is either for changing the printing plates on the plate cylinder, for providing various settings of the inking process, or for cleaning the distributor and inking rollers.

For achieving the operation mentioned above, most machines presently built are fitted on lengthwise extending rails. This allows a disconnection of the links between two successive printing units and the shifting of the units, either upstream or downstream, on the rails to provide a space between two adjacent units which allows access to these units. With certain machine designs, it is possible to pull the printing unit laterally from the whole assembly and, thus, provide access and the possibility of easy working on the rollers. Such solutions, particularly those of shifting the printing units, might become inadequate on larger machines on account of the number of links that need to be disconnected, as well as the weight of the various printing units.

For large machines or installations, the designers have preferred to provide a permanent free space and to add a sheet conveyance device between the printing units. Obviously such a conveying device is expected to be adjustable to the width and thickness of the board or sheets being conveyed. The device used up to now consists of a horizontal frame holding a row of striated shafts extending orthogonally with regard to sheet travelling direction. With this system, two lateral beams are to hold the carrier rollers arranged opposite striated shaft. These two lateral beams are held symmetrically for the sidewise functions, as defined with regard to the lengthwise axis of the machine. Such lateral beams are held by two crosswise shafts, one which is destined to hold the vertical position of the lateral beams and the other to drive the carrier rollers. Sidewise shifting of the lateral beams is insured by threaded axles acting as pairs on both lateral beams. In this way, the actuation of the threaded axles allows the lateral beams to be moved together or apart in such a way that the carrier rollers are moved to a position as required, for instance on the non-printed edges of the sheets or with the possibilities permitting to any other area enabling the conveyance without the hazard of mackling the print. Moreover, the vertical position of the upper frame carrying the striated shafts can be adjusted in such a way as to provide between the shafts and their respective rollers the distance required by the sheet thickness.

The above-described device has numerous drawbacks. In fact, as may easily be understood, the two lateral edges or the area on which the carrier rollers and the striated shafts act should be conspicuously free from print as otherwise the sheets conveyed might be mackled.

If the sheet is carried on its printed edge, mackling will occur. To avoid this, it is appropriate to increase the sheet width in such a way as to obtain transportation on the print-free area. However, this entails unwanted waste.

Another or second drawback involved with this type of arrangement is that the edges or any other area originating from the compulsory sheet pinching which depends on the board features is likely to result in leaving the sheet with imprints, which are unacceptable on the final product to be manufactured from the printed sheets.

A third drawback is that the arrangement involves fastidious settings of the device with regard to width and thickness of the sheets. In fact, on the one hand, it is easy to conceive motorized sidewise shifting of the lateral beams but, on the other hand, vertical setting of the cradle can be achieved mechanically with sufficient precision only by means of considerable backlash on the cams, pinions and levers. As with any setting, several tries are necessary with subsequent correction before a satisfactory result can be obtained. Even after such settings have been carefully obtained, subsequent adjustments, both in the lengthwise and sidewise settings with certain sheets are likely to occur in the course of a production run. Finally, and especially so, this device necessitates a voluminous mechanism causing the cost to increase and limiting access to the upper part of the printing unit, particularly at the contact level between the impression cylinder and the printing plate cylinder.

SUMMARY OF THE INVENTION

The purpose of the present invention consists in providing a device for conveying sheets in a rotary plate printing machine that distinguishes itself by being efficient, for example fast operating, and by preventing lengthwise and sidewise deviations of the sheets. Moreover, it is desirable that the operator be free from any settings of the conveying device and, if ever such settings are necessary, the latter can be done directly by a normal setting process applied on the corresponding printing unit. Finally, such a device is expected to provide more space for accessibility between the cylinders of the printing units and the space is likely to be used for additional operations, such as allows providing driers for drying the printed sheets.

To accomplish these goals, the present invention is concerned with a device for conveying sheets within a rotary sheet printing machine, said device including a horizontal frame made up of two lateral beams connected to one another by crossbars, at least one crosswise shaft held at its ends by the lateral beams, said crosswise shaft being provided with a series of adjacent drive rollers, a lower plate provided with apertures and fitted against the bottom of the lateral beams with portions of each of the rollers extending through the apertures of the plate, at least one suction device, including a collector, such as a hood, connected between the upper sides of the lateral beams and drive means to insure the rotary drive of the crosswise shaft, so that the drive shafts are arranged within a horizontal frame in such a way that the lower part of the circumference of the rollers protrudes through the apertures of the plate and below a lower surface of the plate. The apertures are arranged or sized so that a small gap is provided around the protruding part of each of the drive rollers, and the downstream edges of every aperture of the lower plate is folded upward toward the drive roller. The lower part of the circumference of every drive roller will be situated within a plane, set forth by the upper side or surface of the sheet conveyed through the rotary printing machine and the frame includes means for adjusting the vertical position of the drive rollers relative to an axis of the printing plate cylinder, as required by changes in the thickness of the sheets.

An advantageous result of a first feature to be considered is that the suction device consists of a fan operated in such a way that a vacuum is created within the assembly composed of the collector and the horizontal frame closed by the plate with the apertures. The collector is preferably made up of a certain number of separate compartments and a variable performance fan is preferably provided.

As a result from other features, the means for driving the shaft may consist of a gear or toothed wheel at every shaft end situated on the same machine side, a row of pinions fitted on the corresponding lateral beam connecting each gear to the neighboring gear, and a drive unit, such as either a separate motor unit or a drive shaft which applies a torque to the first gear or the first pinion by means of a reduction gear unit. If the number of shafts is larger than a given number, it is desirable to sub-divide these into two groups, with the first upstream group having their gears interconnected via a first group or row of pinions and the second or downstream group of shafts having their gears interconnected by a second row or group of pinions. In such an arrangement, the drive means, whether it is a separate motor unit or a drive shaft from the main machine, applies a torque through two reduction gear sets by means of a transmission shaft so that each row of pinions will be driven at the same speed.

Other advantages and features of the invention will be readily apparent from the following description of the preferred embodiments, the drawings and claims.

DESCRIPTION OF THE PREFERRED EMBODIMENTS

Figure 1:
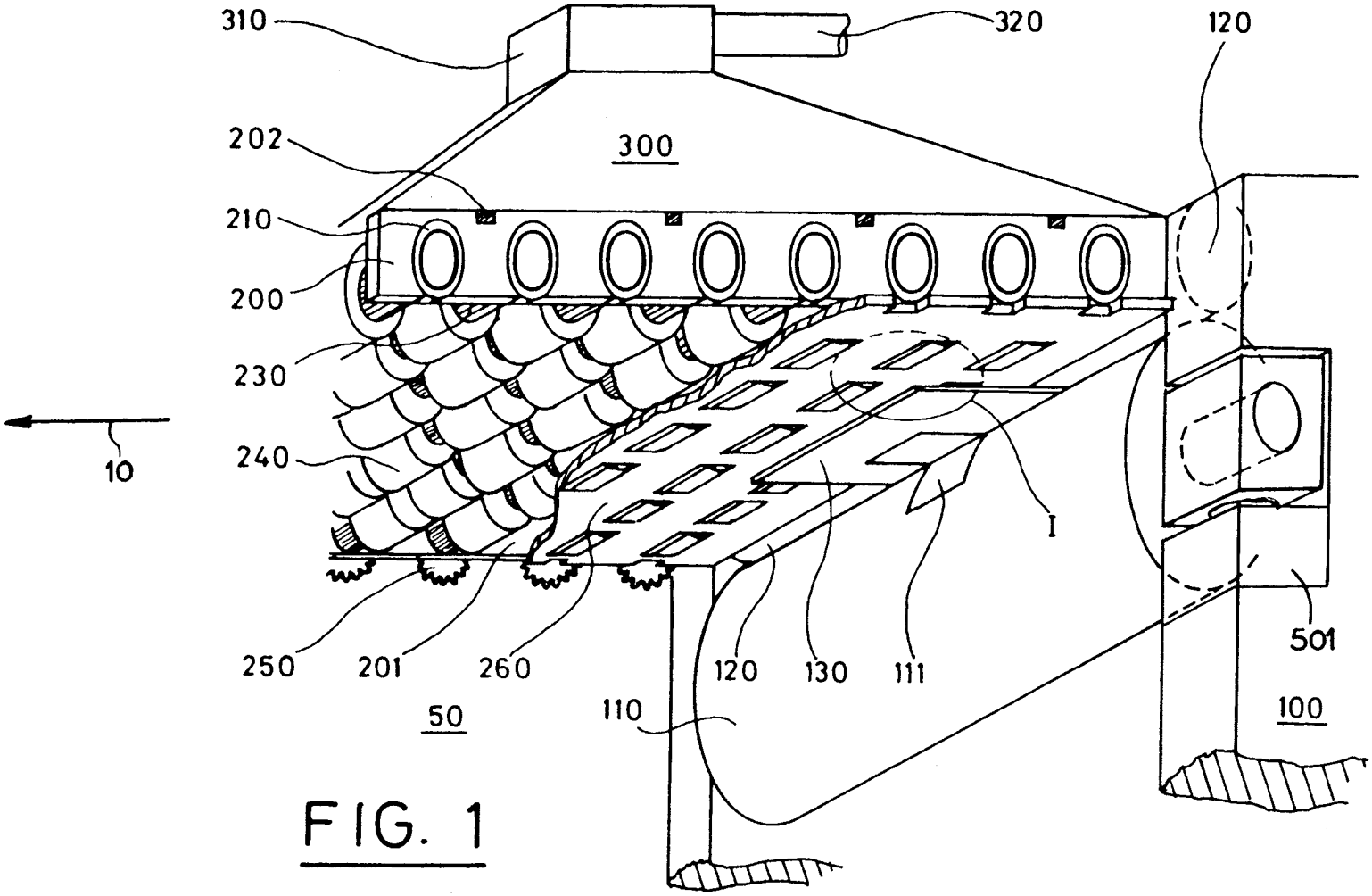
FIG. 1 is a perspective view with portions broken away for purposes of illustration of the conveying device of the present invention.

The principles of the present invention are particularly useful in a conveying arrangement, which is positioned on the outlet of a flexographic rotary printing unit 100. The flexographic rotary printing unit 100 includes a printing plate cylinder 110 with an impression cylinder 120 which is arranged thereabove to extend parallel therewith. In such a unit, the inking rollers and the associated distribution rollers, which are arranged in the lower part of the unit are not illustrated. In the printing operation, a sheet 130 is passed in a direction of arrow 10 between the printing plate cylinder 110 and the impression roller 120 and has a pattern printed on its lower surface by the printing plate 111 of the cylinder 110. As may be noticed, the printing unit downstream is not immediately joined to the upstream printing unit 100 and results in an access space 50, which is provided with the conveying device of the present invention. The conveying device of the present invention consists essentially of a frame composed of two lateral beams 200 and 201, which are connected to one another by a number of cross beams 202. This frame connects the upper part of serially arranged flexo printing units. The lateral beams 200 and 201 hold a row of shafts 230, which are arranged in a parallel sense among themselves and extend orthogonally to the travel direction 10 of the sheet 130. In order to insure the shafts 230 the required mobility for rotation, their ends are engaged in bearings 210 which are provided in the lateral beams 200 and 201.

The shafts 230 are made of one piece and hold a row of axially spaced rollers 240 whose surfaces may be either smooth, striated or provided with a ceramic coating similar to emery paper. The shafts 230 pass through the lateral beam 201 on the side opposite the operator and are provided on their ends with toothed wheels or gears 250 (best illustrated in FIG. 2), which enable them to be rotated in a way to be described hereinafter.

According to an example of realization with a non-exclusive purpose of the device transferring the sheet over a distance of approximately 260 cm, the frame comprises 14 shafts 230, each with a diameter of 7 cm. Every one of these shafts 230 has nine rollers 240 with each of the rollers 240 having a length of about 10 cm and are spaced from one another at a distance of 5 cm along the axis of the shaft. Each of these rollers will have an outer diameter of approximately 9 cm.

The lower edges of the two frame members 200 and 201 form a horizontal plane which receives a plate 260 that is provided with a plurality of rectangular apertures, which are arranged in rows and columns. The apertures are positioned to let a lower portion of each of the drive rollers 240 extend therethrough. In other words, the bearings 210 are located within the beams 200 and 201 of the frame in such a way that the drive rollers have a lower circumferential surface portion that extends below the lower surface of the plate 260. The plate 260 is secured on the frame members, such as 200 and 201, by threaded fasteners. Each of the rectangular apertures has a length and width which is slightly larger than the portion of the roller extending therethrough, as best illustrated in FIG. 1.

Figure 2:
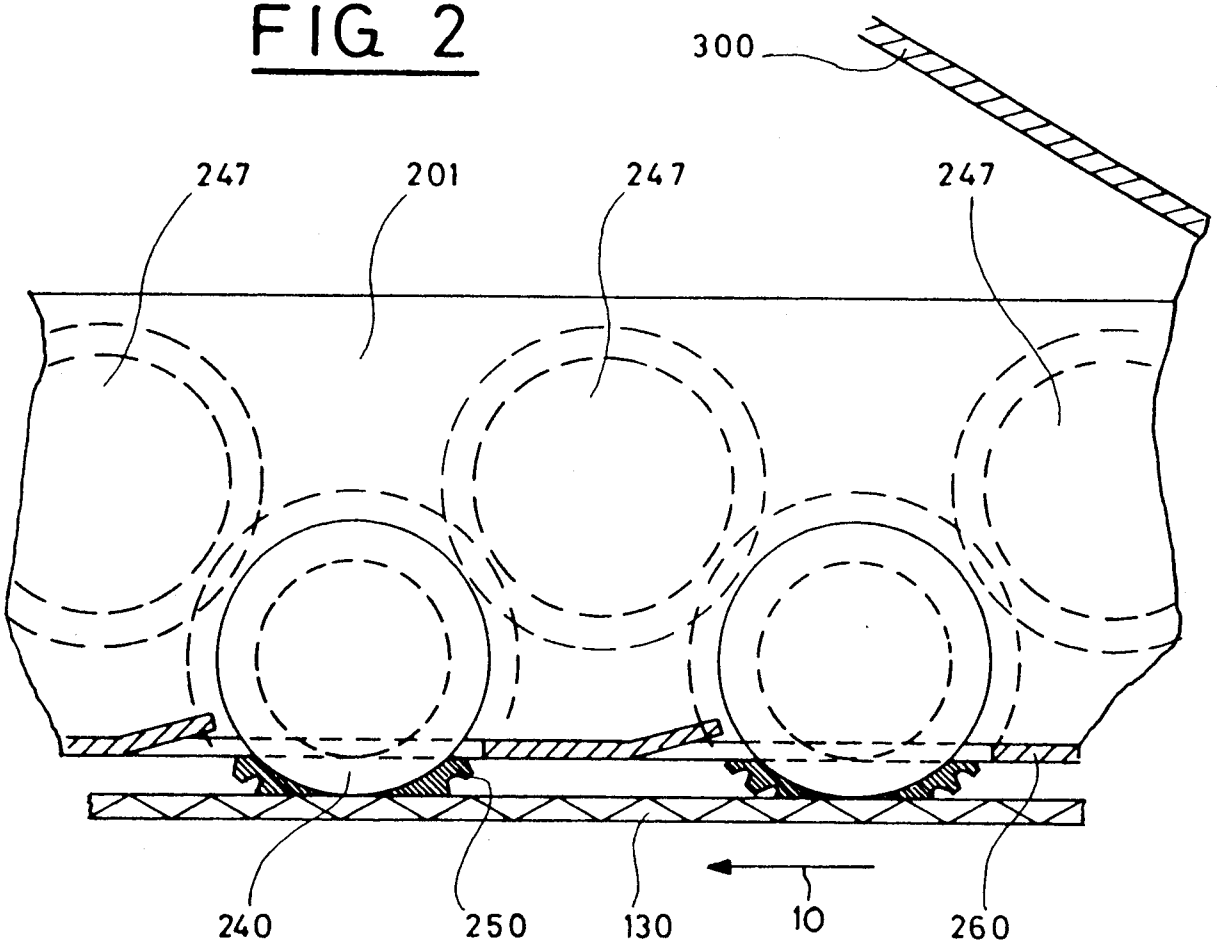
FIG. 2 is a partial cross sectional view taken in the area I of FIG. 1.

As may be seen from FIG. 2, in consideration of the thickness of the plate 260, the drive rollers 240 protrude from this plate 260. Moreover, it can be noticed that the downstream edges 265 of each of the apertures is folded upward toward the axis of the respective roller 240. This particular shape of the downstream edge of the aperture prevents the front edge of the sheet 130 when driven by the rollers 240 from becoming caught or squeezed onto the plate. As may also be seen, this plate 260 covers up the gaps between the drive rollers 240 on the lower frame side leaving a clearance around every lower protruding part of the drive roller.

Figure 3:
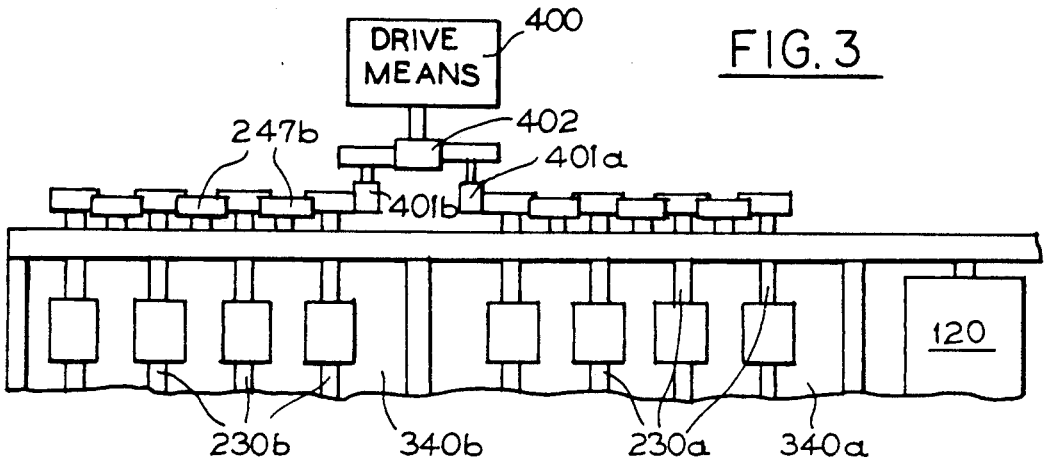
FIG. 3 is a partial top plan view with portions broken away illustrating two compartment with two groups of shafts.

As also shown in FIG. 2, the toothed wheels or gears 250 are situated on the end of the shaft 230 and on the outside of the beam 201 and are in driving engagement with a row of pinions 247, with each pinion connecting two adjacent gears together. Thus, if there are ten gears 250, there will be nine pinions 247. A drive means 400 (FIG. 3), such as an independent electric motor or a transmission shaft transmitting a driving force of the preceding printing unit or the driving force originating from the machine's main drive source or motor is connected by a reduction gear unit or set either to the first gear 250 of a group or to a first pinion 247 of the group of pinions 247. If there are more than about 10 shafts 230, it is appropriate to divide them into two groups, with the first group 230*a* (FIG. 3) being upstream of the second group 230*b*. Each of these groups is provided with a separate group of pinions that interconnect the gears of one shaft with each other with a second group 247*b* of pinions interconnecting the gears of the second group 230*b*. While each of the groups can be driven by a separate drive source, in view of the required timing of rotation, it is desirable to have a single drive source which is doubled in order to be able to simultaneously drive two individual reduction gear sets 401*a*, 401*b*, each engaging with a row of the pinions 247 or a gear 250 of each group. This doubling can be achieved in a conventional way by means of a transmission bridge 402.

As best illustrated in FIG. 1, the device includes a collector shaped as a kind of a hood 300 which covers an upper side of the frame formed by the beams 200 and 201. On top of this hood or collector 300, a fan 310 is arranged with the purpose of blowing air through a duct 320. Alternatively, the duct 320 is connected to the top of the hood and the fan 310 is arranged in another machine area with better accessibility, but in communication with the duct 320. On account of a small passage of air which is limited by the gaps between the plate 260 and every part of the drive rollers 240, the fan, when operating regularly, builds up a vacuum within the hood. In fact, numerous workshop tests have shown that a vacuum of 3 millibars is sufficient to insure the proper operation of the device. Nonetheless, it is possible to use a fan with a variable-performance type such as a variable speed fan to allow, if necessary, a regulated vacuum. It is also possible that the hood 300 can be sub-divided into several compartments 340*a*, 340*b* (FIG. 3), with each compartment being provided with its own air outlet 320 connected to a fan 310 or else to the respective fan.

Figure 4:
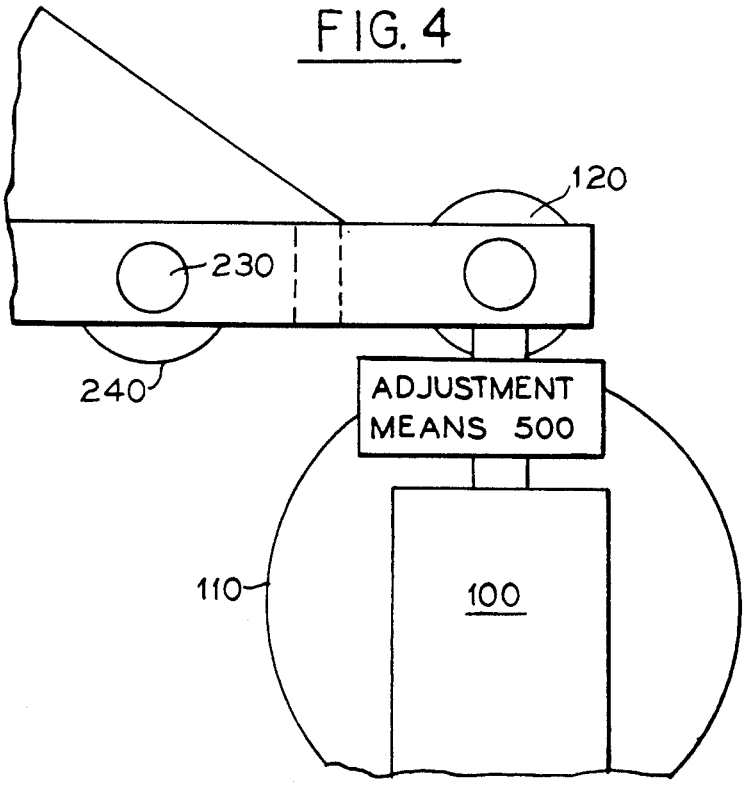
FIG. 4 is a partial side view showing an embodiment of the means for adjusting.

In order to insure proper operation of this device, it is paramount importance that the lower surface of the drive rollers 240 be arranged in the same horizontal plane as the lower surface of the impression cylinder 120 of the upstream and downstream printing units. In other words, the plane corresponding to the upper surface of the sheet being conveyed must contact each of the lower surfaces of the drive rollers 240, as well as the impression cylinders 120. On existing printing units, it is customary to envision the modification of the height of the impression roller with regard to the printing plate cylinder, as required by the thickness of the sheet 130 by changing the position of the impression cylinder relative to the frame by an adjustment means 500 (FIG. 4). In such a case, it is appropriate to simply hook the lateral frame beams 200 and 201 on the impression cylinder setting support on either side. For such a design, a thickness setting of the printing unit will thereby provide a proper positioning of the conveying device. Considering that in case the shifting no longer concerns a cylinder, but a whole device, it might be appropriate to modify the printing unit by placing the impression cylinder in a fixed position (FIG. 1) and then varying the distance or spacing between the printing cylinder and the impression cylinder by shifting the vertical position of the printing plate cylinder by an adjustment means 501 (FIG. 1). Then the frame of the conveying device can be maintained in a fixed position relative to the frame of the printing unit.

As described above, the conveyance device, according to the present invention, operates in the following way. When starting up the printing machine, the fan 310 is also started up with a result that it quickly builds up a vacuum in the hood 300. In the next stage, when the machine is started up with the sheet 130 beginning to be moved forward through the cylindrical printing plate 110 and the impression roller 120, each of the shafts 230 are moved into a clockwise rotation. Thus, the sheet begins to move through the printing unit, as shown in FIG. 1, and its front edge is sucked against the drive rollers 240. On account of their rotation, a forward or pulling force is applied and the drive rollers cause the sheet to move forward in the direction of arrow 10 from right to left, as illustrated in FIG. 1. As may be seen more obviously from FIG. 2, the sheet 130, if sufficiently stiff, will never be in contact with the plate 260. In an extreme case, the sheet will take another shape around the drive roller 240 resulting in an increase of the pushing pressure applied by the drive rollers. Moreover, when the sheet 130 moves forward underneath the plate 260, the air outlet surface of the hood 300 is reduced and a vacuum occurs immediately on the sheet. The atmospheric pressure will then flatten the sheet against the conveying device without any risk of contact with the lower plate 260.

On account of the parallelism between the shafts 230 and on the diameter of the drive rollers 240, as well, and, ultimately, the uniform action of the atmospheric pressure on the sheet 130, the sheet is no longer in a position to drift off lengthwise or sidewise. The sheet will, thus, continue to be aligned with a dependable register determined before it is inserted into the first printing unit. The results of workshop tests have shown that these sheets keep their alignment and registry with sufficient allowance for high-quality flexographic printing. As this precision essentially depends on the operating conditions inside of the plant and as this device has necessitated no particular setting before being put into operation, the dependability of both the alignment and registry during the sheet's forward motion cannot be changed on the long run. Finally, there is very little risk of offal or other small pieces of waste from choking one of the gaps between the plate 260 and a drive roller, because the roller exerts a rotary motion likely to drag the offal or waste into the hood from where it will be evacuated.

Attention may also be drawn to the fact that, contrary to the device described in the present state of the art, no mechanical element is located underneath the sheet within this device. Hence, it will be possible, in case of necessity, to use this space 50 for complementary operations, such as drying, for example. This drying operation would involve only the installation of one or several ramps or hoods to be located underneath the plate 260 and, preferably, arranged to extend at right angles with regard to the direction of movement of the sheet through the device.

Although various minor modifications may be suggested by those versed in the art, it should be understood that I wish to embody within the scope of the patent granted hereon all such modifications as reasonably and properly come within the scope of my contribution to the art.

I claim:

1. A device for conveying sheets within a rotary printing machine having printing units with cylindrical plate cylinders for printing sheets, said device including a horizontal frame having two lateral beams connected to one another by crossbars, at least one cross shaft being mounted for rotation between said lateral beams, each cross shaft being provided with rollers spaced along the shaft, a lower plate provided on a lower surface of the lateral beams, said plate having a separate rectangular aperture for each roller, said apertures allowing a lower portion of the rollers to extend through the plate and below a lower surface of said plate, means for forming a suction including a collector hood being connected to an upper side of the lateral beams, drive means for rotating each cross shaft, each of said apertures having a size greater than the size of the roller extending therethrough to leave a small gap surrounding each of the rollers, a downstream edge of each aperture of the lower plate being bent toward an axis of the roller, said rollers being positioned with the lower edge forming a plane for engaging an upper surface of a sheet being conveyed through the rotary printing machine and said frame including means for adjusting a vertical position of the rollers relative to an axis of the printing plate cylinder, as required by changes in the thickness of said sheet.

2. A device according to claim 1, wherein the means for forming a suction consists of a fan operated in such a way as to produce a vacuum within an assembly consisting of the collector hood and the horizontal frame closed by the plate with apertures.

3. A device according to claim 1, wherein the collector hood consists of a certain number of separate compartments.

4. A device according to claim 1, wherein the means for forming a suction includes a variable speed fan allowing adjustment of the amount of vacuum within an assembly consisting of the collector hood and the horizontal frame closed by the plate with apertures.

5. A device according to claim 1, wherein at least two cross shafts are provided, and the drive means for rotating the cross shafts includes a gear being positioned on each shaft laterally disposed with one of said beams, a pinion mounted on the one beam between every two adjacent gears to engage the two adjacent gears, and said drive means imparting a torque to one of the selected gears and pinions.

6. A device according to claim 5, wherein there is a plurality of cross shafts, said shafts being arranged in a first group followed by a second group, each of said shafts of the first group having a gear, and a first group of pinions arranged with each pinion engaging two adjacent gears, each of the shafts of the second group having a gear and a second group of pinions arranged with each pinion of the second group being in meshing engagement with two adjacent gears of the second group, said drive means including a transmission shaft with two reduction gear sets, with one set being connected to a gear of the first group, and the other of the two sets being connected to a gear of the second group.

7. A device according to claim 1, wherein means for adjusting a vertical position comprises connecting the lateral beams to a support for an impression cylinder of a printing unit of the machine to move with movement of said impression cylinder.

8. A device according to claim 1, wherein the means for adjusting the position comprises adjusting the printing plate cylinder of a printing unit relative to an impression roll.

9. A device for conveying sheets within a rotary machine having at least two printing units, said device comprising a frame having two lateral beams connected to one another by cross beams to form a bottom surface having a plate being attached thereto, said plate having a lower surface and a plurality of rectangular apertures arranged in rows and columns, a plurality of cross-shafts being mounted for rotation on the lateral beams, with one shaft aligned with each column of apertures in said plate, each cross-shaft having a plurality of pressure rollers positioned above the apertures of the column with a lower portion of each roller extending through its respective aperture to protrude below said lower surface of said plate, means for rotating each of shafts, and suction means for applying a suction in the frame to draw a sheet onto the rollers and toward said plate.

10. A device according to claim 9, wherein the means for rotating said shafts includes a gear fastened on each shaft adjacent one cross beam, a plurality of pinions arranged on said one beam with a pinion in meshing relationship with two adjacent gears, and a source of rotational movement engaging a selected one of the pinions and gears.

11. A device according to claim 9, wherein each of the apertures on a downstream side has an edge folded toward an axis of the roller.

* * * * *